313-414 SR
9/25/84 XR 4,473,773

United States Patent [19]
Sakurai et al.

[11] Patent Number: 4,473,773
[45] Date of Patent: Sep. 25, 1984

[54] IN-LINE TYPE ELECTROMAGNETIC FOCUSING CATHODE-RAY TUBE

[75] Inventors: Soichi Sakurai, Yokohama; Kyohei Fukuda, Fujisawa; Kuniharu Osakabe, Mobara, all of Japan

[73] Assignee: Hitachi, Ltd., Tokyo, Japan

[21] Appl. No.: 287,794

[22] Filed: Jul. 28, 1981

[30] Foreign Application Priority Data

Sep. 10, 1980 [JP] Japan ..... 55-124528

[51] Int. Cl.[3] ..... H01J 29/51; H01J 29/56; H01J 29/64

[52] U.S. Cl. ..... 313/412; 313/413; 313/414; 313/431; 313/440

[58] Field of Search ..... 313/413, 414, 440, 431, 313/412

[56] References Cited

U.S. PATENT DOCUMENTS 4,362,964 12/1982 Sakurai et al. ..... 313/412 X

*Primary Examiner*—Palmer C. Demeo
*Attorney, Agent, or Firm*—Antonelli, Terry & Wands

[57] ABSTRACT

An improved in-line type electromagnetic focusing cathode-ray tube which comprises magnetic yokes, a focusing magnetic field generating permanent magnet, a deflecting magnetic field control element and a cup-shaped spacer member for separating the magnetic yokes from the deflecting magnetic field control element. The deflecting magnetic field control element is disposed at a distance $l \geqq 0.26$ D from an end of the magnetic yoke closest to a fluorescent screen, where D is an outer diameter of the magnetic yoke, so that a beam spot on the fluorescent screen has substantially circular shape to attain an excellent focusing characteristic.

13 Claims, 6 Drawing Figures

IN-LINE TYPE ELECTROMAGNETIC FOCUSING CATHODE-RAY TUBE

BACKGROUND OF THE INVENTION

The present invention relates to an electromagnetic focusing cathode-ray tube, and more particularly to an in-line type electromagnetic cathode-ray tube having an improved beam spot shape.

In an in-line type electromagnetic focusing cathode-ray tube, three in-line electron beams pass through a first grid and a second grid and are focused into narrow beams to form a so-called crossover, and they are then accelerated by an anode voltage and reach a fluorescent screen. On the other hand, a magnetic yoke made of a high permeability magnetic material absorbs magnetic fluxes emanated from a permanent magnet to produce focusing magnetic field one for each of the three in-line electron beams to form individual magnetic main lenses therein. In the prior art in-line type electromagnetic focusing cathode-ray tube, however, since a deflecting magnetic field control element is made of a high permeability magnetic material, it disturbs the beam focusing magnetic fields although it is arranged away from the permanent magnet much farther than the magnetic yoke. As a result, the beam spot on the fluorescent screen is flattened and focusing characteristics are adversely affected.

SUMMARY OF THE INVENTION

It is an object of the present invention to provide an in-line type multi-electron beam electromagnetic focusing cathode-ray tube having an improved focusing characteristic which presents a susbtantially absolutely circular beam spot.

In order to attain the above object, in accordance with the present invention, a deflecting magnetic field control element is displaced from an end of that one of a plurality of magnetic yokes which is disposed closest to the fluorescent screen toward the fluorescent screen along an axis of the tube by a distance which is no less than 0.26 times as long as an outer diameter of the magnetic yoke so that the magnetic fluxes of the permanent magnet are not substantially absorbed by the deflecting magnetic field control element and the focusing magnetic fields of the permanent magnet do not substantially affect the control element.

DETAILED DESCRIPTION OF THE PREFERRED EMBODIMENT

In order to facilitate the understanding of the present invention, a prior art in-line type electromagnetic focusing cathode-ray tube is first explained below.

Figure 1:
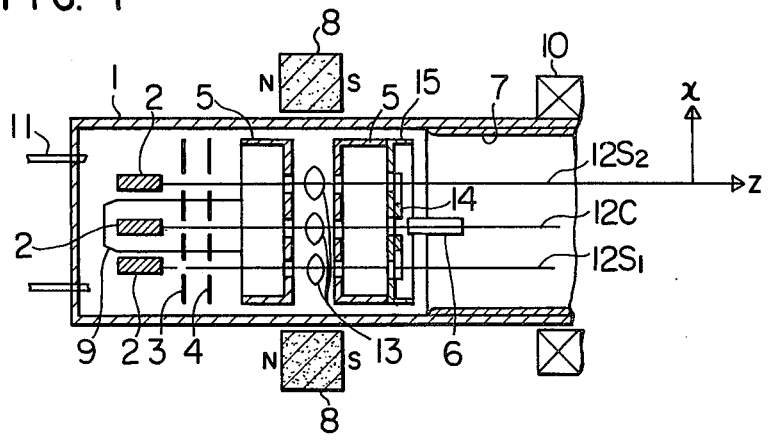
PRIOR ART FIG. 1
FIG. 1 shows a sectional view of a prior art in-line type multi-electron beam electromagnetic focusing cathode-ray tube, taken along a plane of in-line arrangement.
Figure 2:
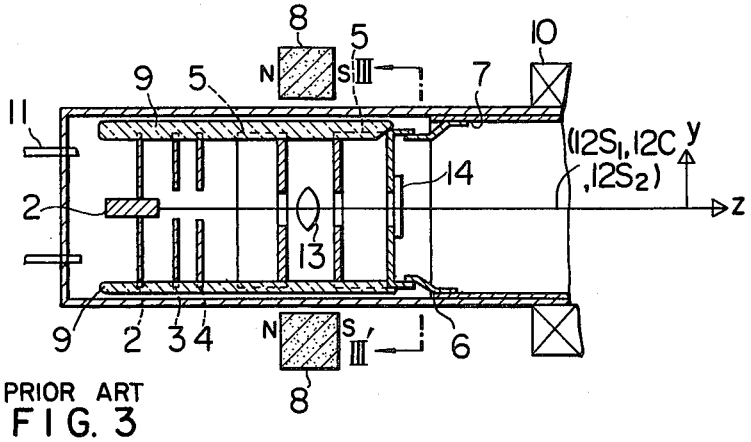
PRIOR ART FIG. 2
FIG. 2 shows a sectional view of the cathode-ray tube of FIG. 1, taken along a plane which includes an axis of the tube and is normal to the plane of the in-line arrangement.
Figure 3:
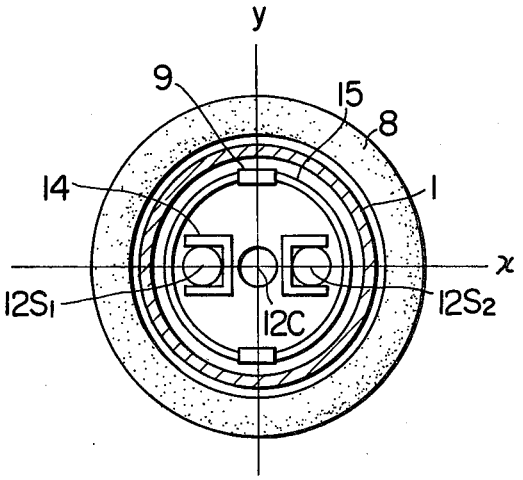
PRIOR ART FIG. 3
FIG. 3 shows a sectional view taken along a line III—III' in FIG. 2.
Figure 4:
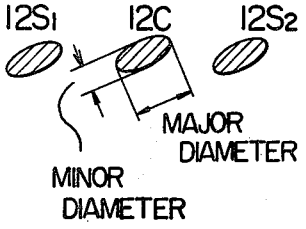
PRIOR ART FIG. 4
FIG. 4 shows a flat electron beam spot produced by the cathode-ray tube shown in FIGS. 1 to 3.

FIGS. 1 to 3 show an example of a prior art in-line and external magnet type electromagnetic focusing cathode-ray tube having a ring-shaped permanent magnet disposed externally as a magnetic field generating source. FIG. 1 shows a sectional view of a neck section taken along a plane of in-line arrangement, FIG. 2 shows a sectional view of the neck section taken along a plane which includes an axis of the tube and is normal to the plane of the in-line arrangement, and FIG. 3 shows a sectional view taken along a line III—III' in FIG. 2. In FIGS. 1 to 3, numeral 1 denotes a neck of a bulb, 2 denotes a cathode, 3 denotes a first grid, 4 denotes a second grid, 5 denotes a pair of magnetic yokes, 6 denotes a conductive support, 7 denotes an inner conductive film deposited on an inner surface of the bulb and having an anode voltage applied thereto, 8 denotes a ring-shaped permanent magnet which serves as a focusing magnetic field source, 9 denotes an electrode support rod made of glass, 10 denotes a deflection yoke, 11 denotes stem pins connected to electrodes, 12C denotes a center beam, $\mathbf{12S_1}$ and $\mathbf{12S_2}$ denote side beams, 13 denotes individual magnetic main lenses illustrated in analogy to optical lenses, 14 denotes a deflecting magnetic field control element and 15 denotes a cup-shaped spacer made of non-magnetic stainless steel. The three in-line electron beams, the center beam 12C and the side beams $\mathbf{12S_1}$ and $\mathbf{12S_2}$, emanating from the cathode 2 pass through the first grid 3 and the second grid 4 and are focused into narrow beams to form a so-called crossover. The electron beams are then accelerated by the magnetic yokes 5 to which the anode voltage is applied from the inner conductive film 7 through the conductive support 6 and they reach a fluorescent screen, not shown. On the other hand, the magnetic yoke 5 made of high permeability magnetic material absorbs the magnetic fluxes emanated from the permanent magnet 8 to create a strong focusing magnetic field between the pair of magnetic yokes 5 to form individual magnetic main lenses 13 thereat. The permanent magnet 8 is disposed at the midpoint of the pair of magnetic yokes 5 so that the uniform focusing magnetic field is created. The three electron beams 12C, $\mathbf{12S_1}$ and $\mathbf{12S_2}$ are focused by the main lenses 13 to form crossover images on phosphor stripes of respective colors. If the three electron beams 12C, $\mathbf{12S_1}$ and $\mathbf{12S_2}$ do not converge and cross over at one point on a shadow mask, color shading takes place and a quality of color image is degraded. The deflecting magnetic field control element 14 is arranged on the cup-shaped spacer 15 of non-magnetic stainless steel as shown (see particularly FIG. 3) so that the three electron beams are correctly converged on the shadow mask even when the electron beams scan a peripheral area of the shadow mask in order to prevent the degradation of the quality of image when the peripheral area of the shadow mask is scanned. The control element 14 is normally made of high permeability magnetic material such as permalloy and it effectively and properly brings leakage magnetic fluxes from the deflecting yoke 10 into interaction with the center beam 12C and the side beams $\mathbf{12S_1}$ and $\mathbf{12S_2}$ so that the beams are correctly converged even in the peripheral area of the screen. However, since the deflecting magnetic field control element 14 is made of the high permeability magnetic material, it disturbs the beam focusing magnetic field although it is away from the permanent magnet 8 much further than the magnetic yokes 5. As a result, a flat beam spot is produced as shown in FIG. 4 and the focusing characteristic is adversely affected to a large extent.

An improved in-line type electromagnetic focusing cathode-ray tube in accordance with the present invention is now explained.

Figure 5:
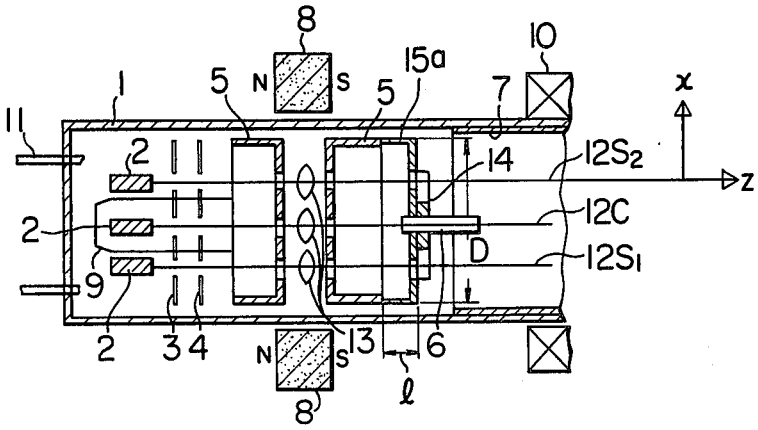
FIG. 5 shows an embodiment of the present invention.
Figure 6:
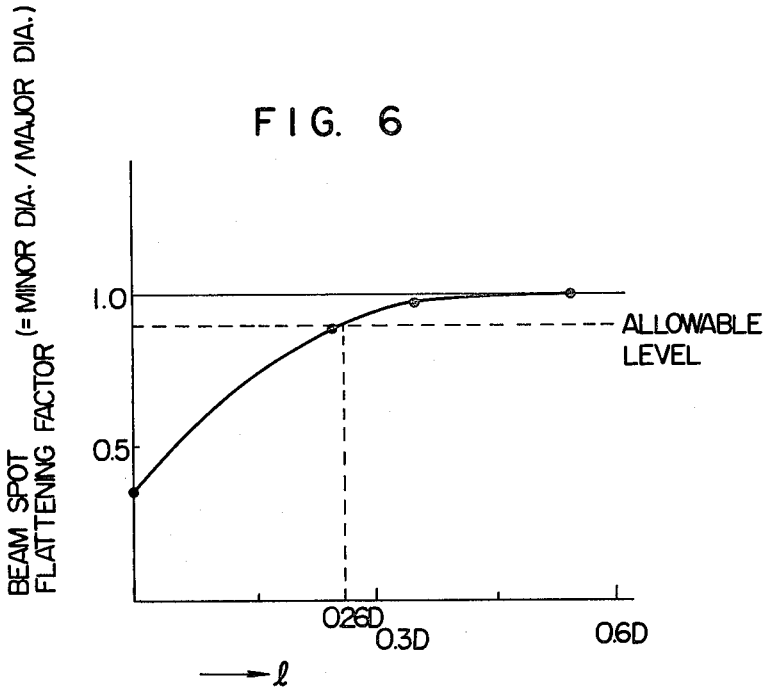
FIG. 6 shows a graph illustrating a relationship between a distance l shown in FIG. 5 and a flattening factor of electron beam spot.

FIG. 5 shows an embodiment of the present invention. The deflecting magnetic field control element 14 is attached to a base 15*a* of non-magnetic stainless steel which is similar in shape to the cup-shaped spacer 15 shown in FIG. 1 and attached to an end of the magnetic yoke 5 closer to the fluorescent screen and which is oriented such that the bottom surface of the cylinder faces to the fluorescent screen (as opposed to the spacer 15 of FIG. 1). In FIG. 5, l denotes a distance or length of the spacer 15*a* extending in the axial direction of the tube from a position at which the deflecting magnetic field control element 14 is disposed to the end of the magnetic yoke 5 closer to the fluorescent screen, and D denotes an outer diameter of the magnetic yoke 5. The distance l is selected to meet a relation of $l \geqq 0.26$ D which the inventors of the present invention found after a number of times of experiments for actual bulbs, a relationship as shown in FIG. 6 between the distance l and a flattening factor of beam spot (ratio of minor diameter to major diameter of the beam spot). The conditions involved are that the anode voltage is 20 KV, a beam current is 4 mA and a maximum magnetic flux on the axis is 680 gauss. As seen from FIG. 6, as the distance l increases, the flattening factor of beam spot is increased or it approaches 1.0. It has been proved from experimental data on an entire surface focusing characteristic and the flattening factor of beam spot that the entire surface focusing characteristic is acceptable if the flattening factor is no less than 0.9. In the light of the above, the distance l has been set to be no less than 0.26 D at which the flattening factor of beam spot is 0.9. On the other hand, regarding the upper limit of the distance l, it is usual to select the distance l as small as possible because the shorter the entire length of the electron gun the higher is the mass-productivity and the more advantageous is the utilization of the cathode-ray tube. While the illustrated embodiment shows the permanent magnet serving as the magnetic field source disposed externally of the neck, it should be understood that the same is true when a D.C. excited coil is used instead of the permanent magnet or the permanent magnet is disposed internally of the neck to form an inner magnet type.

As described hereinabove, according to the present invention, the beam spot is improved in shape to be a substantially ideal circle, so that a picture may be improved in quality.

We claim:

1. An in-line type electromagnetic focusing cathode-ray tube comprising:

(a) at least two magnetic yokes each having a plurality of electron beam passing apertures, said magnetic yokes being arranged along a direction of travel of electron beams, (b) means disposed on a selected one of an external or an internal portion of a neck of said cathode-ray tube between said magnetic yokes to generate an electron beam focusing magnetic field, said focusing magnetic field individually focusing a plurality of electron beams arranged on a plane including an axis of said cathode-ray tube, (c) a cup-shaped spacer member disposed at an end of that one of said plurality of magnetic yokes which is closest to a fluorescent screen, at an area of said fluorescent screen on the axis of said cathode-ray tube, and (d) a deflecting magnetic field control element disposed on the surface of said cup-shaped spacer member and on a plane normal to the axis of said cathode-ray tube for converging said plurality of electron beams to a desired deflecting scan point on said fluorescent screen, said deflecting magnetic field control element being disposed away from said end of said magnetic yoke toward said fluorescent screen by a predetermined distance on the axis of said cathode-ray tube, said predetermined distance being no less than 0.26 times as long as an outer diameter of said magnetic yoke.

2. An in-line type electromagnetic focusing cathode-ray tube according to claim 1 wherein said deflecting magnetic field control element is of U-shape and made of a high permeability magnetic material such as permalloy.

3. An in-line type electromagnetic focusing cathode-ray tube according to claim 1 wherein the number of the electron beams is three and said deflecting magnetic field control element is arranged on travel paths of only two side electron beams.

4. An in-line type electromagnetic focusing cathode-ray tube according to claim 1 wherein said cup shaped spacer member is made of non-magnetic stainless steel.

5. An in-line type electromagnetic focusing cathode-ray tube according to claim 1 wherein said electron beam focusing magnetic field generating means comprises a permanent magnet disposed between said magnetic yokes around an outer circumference of a neck of said cathode-ray tube.

6. An in-line type electromagnetic focusing cathode-ray tube comprising:

(a) a pair of magnetic yokes each having three electron beam passing apertures, said pair of magnetic yokes being arranged in a direction of travel of the electron beams, said three electron beam passing apertures of each of said magnetic yokes opposing to each other, (b) a permanent magnet disposed between said pair of magnetic yokes around an outer circumference of a neck of said cathode-ray tube for individually focusing said three electron beams, (c) a non-magnetic stainless steel cup-shaped spacer disposed at an end of that one of said pair of magnetic yokes which is closer to a fluorescent screen, at an area of said fluorescent screen on an axis of said cathode-ray tube, and (d) a deflecting magnetic field control element disposed on a surface of said cup-shaped spacer and on a plane normal to the axis of said cathode-ray tube to converge said three electron beams to a desired deflecting scan point on said fluorescent screen, said deflecting magnetic field control element being disposed at a distance $l \geqq 0.26$ D from the end of said magnetic yoke, where D is an outer diameter of said magnetic yoke.

7. An in-line type electromagnetic focusing cathode-ray tube comprising:

(a) at least two magnetic yokes each having a plurality of electron beam passing apertures, the magnetic yokes being arranged along a direction of travel of electron beams, (b) means disposed on a selected one of an external or an internal portion of a neck of the cathode-ray tube between the magnetic yokes for generating an electron beam focusing magnetic field, the focusing magnetic field individually focusing a plurality of electron beams arranged on a plane including an axis of the cathode-ray tube, (c) deflecting magnetic field control means disposed on a plane normal to the axis of the cathode-ray tube for converging the plurality of electron beams to a desired deflecting scan point on a fluorescent screen of the cathode-ray tube, and (d) spacer means disposed at an end of the one of the plurality of magnetic yokes which is closest to the fluorescent screen, at an area of the fluorescent screen on the axis of the cathode-ray tube, the spacer means having the deflecting magnetic field control means disposed thereon, the spacer means having a length extending in the axial direction of the cathode-ray tube for spacing the deflecting magnetic field control means a distance along the axis of the cathode-ray tube away from the end of the magnetic yoke and toward the fluorescent screen sufficient to prevent the deflecting magnetic field control means from disturbing the beam focusing magnetic field so as to enable a beam spot of substantially circular shape to be produced on the fluorescent screen.

8. An in-line type electromagnetic focusing cathode-ray tube according to claim 7, wherein the deflecting magnetic field control means comprises an element of U-shape and made of a high permeability magnetic material.

9. An in-line type electromagnetic focusing cathode-ray tube according to claim 7, wherein the number of the electron beams is three, and the deflecting magnetic field control means is arranged on travel paths of only two side electron beams.

10. An in-line type electromagnetic focusing cathode-ray tube according to claim 7, wherein the electron beam focusing magnetic field generating means comprises a permanent magnet disposed between the magnetic yokes around an outer circumference of a neck of the cathode-ray tube.

11. An in-line type electromagnetic focusing cathode-ray tube comprising:

(a) at least two magnetic yokes each having a plurality of electron beam passing apertures, the magnetic yokes being arranged along a direction of travel of electron beams, (b) means disposed on a selected one of an external or an internal portion of a neck of the cathode-ray tube between the magnetic yokes for generating an electron beam focusing magnetic field, the focusing magnetic field individually focusing a plurality of electron beams arranged on a plane including an axis of the cathode-ray tube, (c) deflecting magnetic field control means disposed on a plane normal to the axis of the cathode-ray tube for converging the plurality of electron beams to a desired deflecting scan point on a fluorescent screen of the cathode-ray tube, and (d) spacer means disposed at an end of the one of the plurality of magnetic yokes which is closest to the fluorescent screen, at an area of the fluorescent screen on the axis of the cathode-ray tube, the spacer means having the deflecting magnetic field control means disposed thereon for spacing the deflecting magnetic field control means a predetermined distance along the axis of the cathode-ray tube away from the end of the magnetic yoke and toward the fluorescent screen for eliminating disturbance of the beam focusing magnetic field by the deflecting magnetic field control means so as to enable a beam spot of substantially circular shape to be produced on the fluorescent screen, the spacer means being a cup-shaped spacer member opening in the direction of the magnetic yoke, the deflecting magnetic field control means being disposed on an exterior surface of the cup-shaped spacer member facing the fluorescent screen.

12. An in-line type electromagnetic focusing cathode-ray tube according to claim 11, wherein the cup-shaped spacer member is made of non-magnetic stainless steel.

13. An in-line type electromagnetic focusing cathode-ray tube comprising:

(a) at least two magnetic yokes each having a plurality of electron beam passing apertures, the magnetic yokes being arranged along a direction of travel of electron beams, (b) means disposed on a selected one of an external or an internal portion of a neck of the cathode-ray tube between the magnetic yokes for generating an electron beam focusing magnetic field, the focusing magnetic field individually focusing a plurality of electron beams arranged on a plane including an axis of the cathode-ray tube, (c) deflecting magnetic field control means disposed on a plane normal to the axis of the cathode-ray tube for converging the plurality of electron beams to a desired deflecting scan point on a fluorescent screen of the cathode-ray tube, and (d) spacer means disposed at an end of the one of the plurality of magnetic yokes which is closest to the fluorescent screen, at an area of the fluorescent screen on the axis of the cathode-ray tube, the spacer means having the deflecting magnetic field control means disposed thereon for spacing the deflecting magnetic field control means a predetermined distance along the axis of the cathode-ray tube away from the end of the magnetic yoke and toward the fluorescent screen for eliminating disturbance of the beam focusing magnetic field by the deflecting magnetic field control means so as to enable a beam spot of substantially circular shape to be produced on the fluorescent screen, the predetermined distance being at least 0.26 times as long as an outer diameter of the magnetic yoke.

* * * * *